United States Patent [19]

Pawlow

[11] 4,187,747

[45] Feb. 12, 1980

[54] QUICK RELEASE MECHANISM FOR SOCKET WRENCH

[75] Inventor: Roy E. Pawlow, Middletown, Conn.

[73] Assignee: Litton Industrial Products, Inc., New Britian, Conn.

[21] Appl. No.: 879,798

[22] Filed: Feb. 21, 1978

[51] Int. Cl.[2] ..... B25B 13/00

[52] U.S. Cl. ..... 81/177 G

[58] Field of Search ..... 81/177 G, 180 R; 403/325, 328

[56] References Cited

U.S. PATENT DOCUMENTS

| | | | |
|---|---|---|---|
| 2,954,994 | 10/1960 | Beers | 403/328 |
| 3,208,318 | 9/1965 | Roberts | 81/177 G |
| 3,532,013 | 10/1970 | Haznar | 81/177 G X |
| 3,713,356 | 1/1973 | Knudsen | 81/177 G |
| 3,762,245 | 10/1973 | Smyers et al. | 81/177 G |

FOREIGN PATENT DOCUMENTS

| | | | |
|---|---|---|---|
| 703651 | 2/1965 | Canada | 81/177 G |

*Primary Examiner*—James G. Smith
*Attorney, Agent, or Firm*—Brian L. Ribando

[57] ABSTRACT

The driving stud of a socket wrench includes an aperture through which a detent protrudes to lock a socket thereon. A push bar mounted in the head of the socket wrench is notched to receive the detent and may be shifted to allow retraction of the detent and release of the socket. The notch is formed with a trough to prevent twisting of the push bar with respect to the axis of the aperture and to insure the proper seating of the detent on two surfaces of the trough.

3 Claims, 5 Drawing Figures

Fig_3
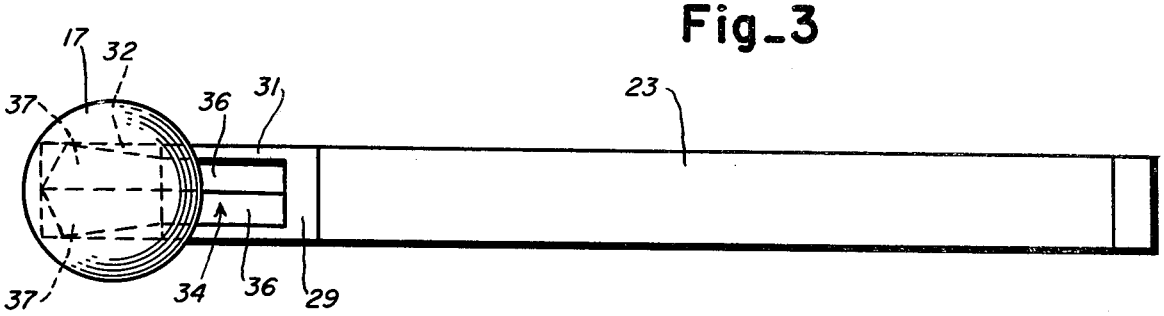
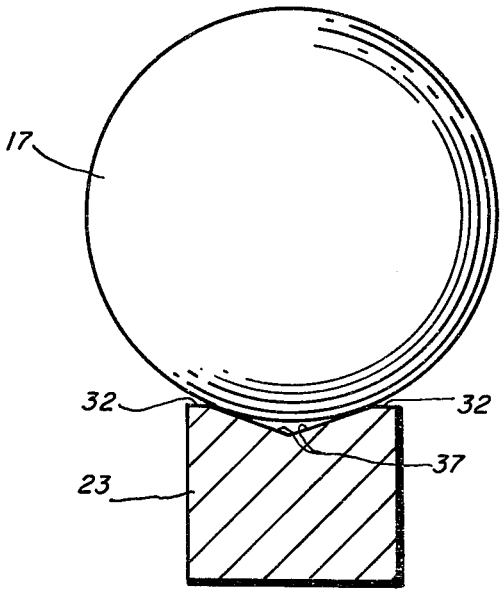
Fig_4
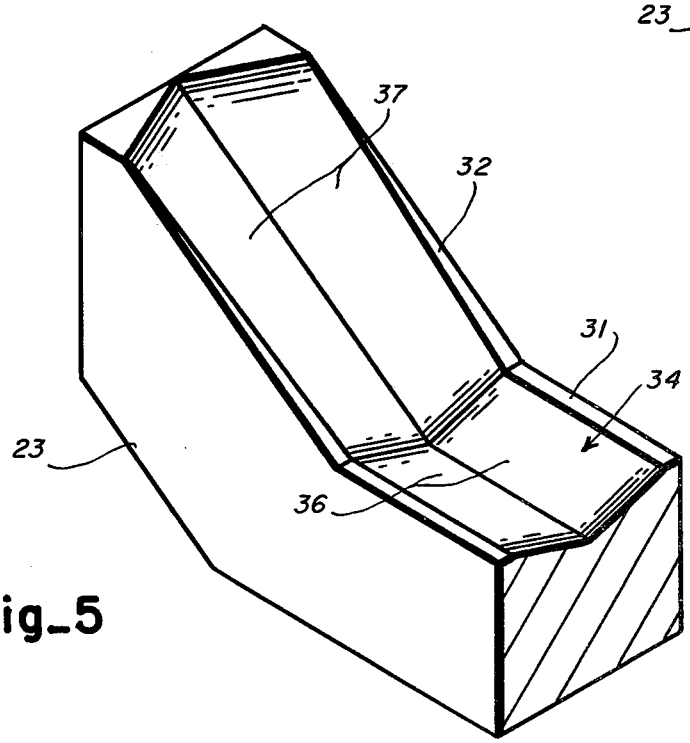
Fig_5

QUICK RELEASE MECHANISM FOR SOCKET WRENCH

BACKGROUND OF THE INVENTION

The invention relates to a socket wrench, and more particularly, to a quick release mechanism for a socket wrench comprising a notched push bar and a retractable detent which locks a socket onto the driving stud of the wrench.

Socket wrenches which are used to drive one of a set of progressively sized sockets are well known in the prior art. One problem associated with such wrenches is the provision of a means for locking a socket onto the driving stud of a wrench, which means must also allow the socket to be removed from the driving stud. One such mechanism is shown in U.S. Pat. No. 3,208,318 issued on Sept. 28, 1965. In this patent, a spring loaded pin is notched and provides a recess into which a detent may retract. The detent is normally urged outwardly through an aperture in the driving stud by the angled edge of the notch. A push button on the pin is provided for retracting the pin and allowing the detent to fall into a deeper portion of the notch. Another arrangement is shown in U.S. Pat. No. 3,762,245 issued on Oct. 2, 1973. In one embodiment, this patent shows a spring loaded pin having a sloping end portion which normally engages a bore in a detent which protrudes from the driving stud of a wrench. Pressure on the pin in opposition to the spring causes a narrow portion of the sloped pin to enter the bore of the detent allowing the detent to be retracted from its normally projected and socket engaging position. Such prior art devices are expensive to manufacture and subject to malfunction and wear.

SUMMARY AND OBJECTS OF THE INVENTION

In accordance with the present invention, a socket wrench includes a driving stud having a bore from which a detent protrudes. The detent is urged to a protruding position from the bore by a spring loaded push bar having an angled notch formed therein. Pressure on the push bar against the spring causes a deeper segment of the notch to be aligned with the bore allowing the detent to retract into the stud. The angled notch on the push bar is formed with a V-shaped trough. The trough presents two surfaces on which the detent seats and prevents the push bar from being twisted relative thereto.

It is, therefore, an object of the invention to provide a socket wrench having a retractable socket engaging detent thereon.

It is a further object of the invention to provide a socket wrench having a spring loaded push bar formed with a notch to receive a detent for locking a socket thereon.

It is another object of the invention to provide a socket wrench having a spring loaded push bar formed with a notch having a V-shaped trough to seat a detent thereon and to prevent twisting of the pin with respect thereto.

These and other objects of the invention will become apparent from the following detailed description taken in conjunction with the accompanying drawing figures in which like reference numerals designate like or corresponding parts throughout the figures.

BRIEF DESCRIPTION OF THE DRAWING

FIG. 3 is a plan view of the push bar of FIG. 2;

FIG. 4 is a view partially in section of the push bar of FIG. 3; and

FIG. 5 is a perspective view of the end of the push bar.

DESCRIPTION OF THE PREFERRED EMBODIMENT

Figure 1:
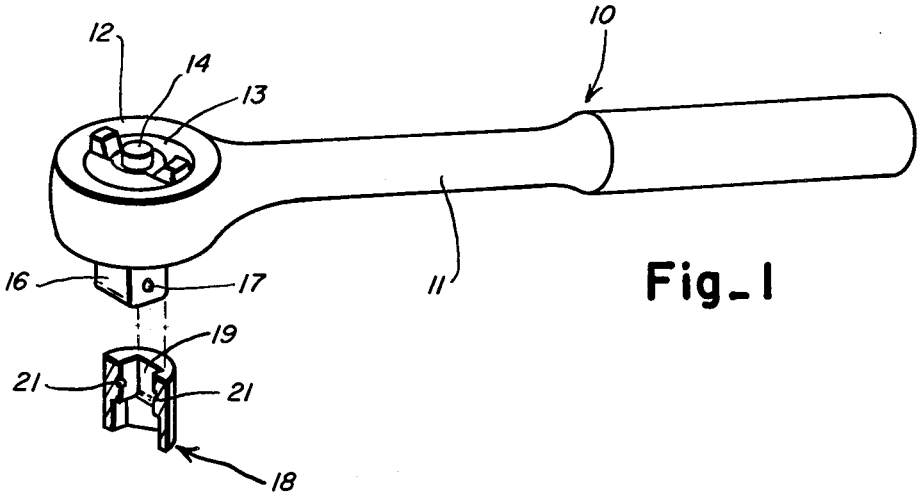
FIG. 1 is a perspective view of a socket wrench showing in section a socket in exploded relation thereto.

Referring now to the drawings, there is shown in FIG. 1 a socket wrench generally designated by the reference numeral 10. The wrench includes an elongated handle 11 and a head 12. Positioned on the head is a cap 13 and a depressible button 14. Opposite the cap 13 and the button 14 is a driving stud 16 and protruding from the driving stud 16 is a detent 17. Shown below the driving stud 16 and partially in section is a socket indicated generally at 18. The socket 18 includes a central aperture 19 which is dimensioned to mate with the driving stud 16. Within the aperture 19 are one or more recesses 21, which recesses are positioned to receive the detent 17 when the socket 18 is mounted on the driving stud 16.

Figure 2:
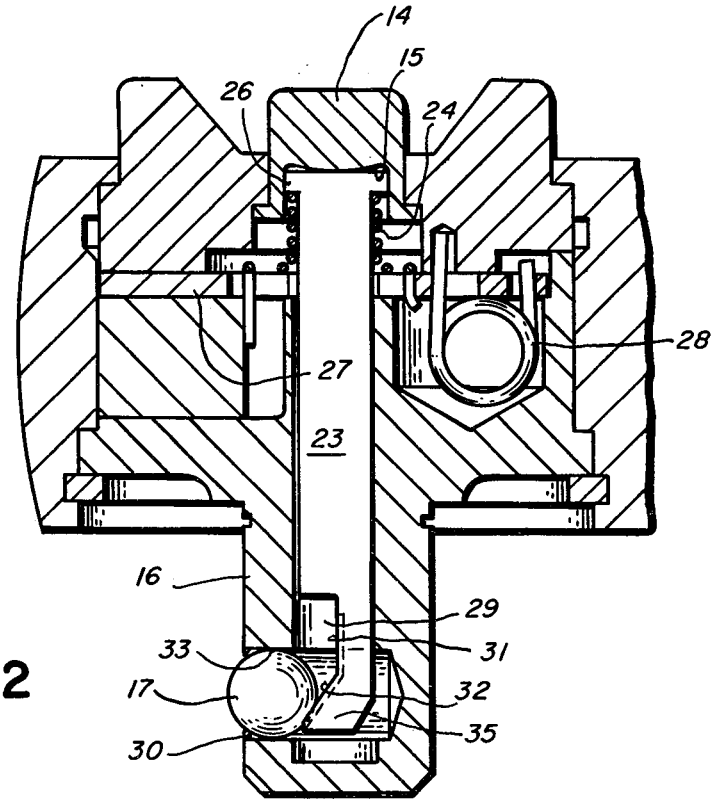
FIG. 2 is a sectional view of the driving stud of a socket wrench.

Turning now to FIG. 2, it will be seen that the underside of button 14 is formed with a convex surface 15 which abuts an end of a flat push bar 23. The convex surface 15 prevents a clutching between the button 14 and the push bar 23 which could result in an undesired twisting of the push bar. If desired, the end of the push bar could be made convex. The push bar 23 is resiliently urged to the position shown by a coil spring 24 which bears on a shoulder 26 formed on one end of the push bar and on a shift plate 27. A shift spring 28 is provided to allow proper functioning of the shift plate 27. The end of the push bar 23 which is remote from the shoulder 26 is formed with a notch 29. The notch 29 includes a constant depth portion 31 and a sloped portion 32. Received within the notch 29 is the detent 17. The sloped portion 32 urges the detent 17 outwardly to protrude through a bore 33 which is formed in the side of the driving stud 16. The detent 17 is retained within the bore 33 by a constriction 30 and is dimensioned to prevent the passage of a bar tip 35 therepast.

Turning now to FIGS. 3 and 5, the push bar 23 will be seen to have a trough 34 formed in the notch 29. The trough 34 has a general V-shape and comprises surfaces 36 along the constant depth section 31 and surfaces 37 along the sloped section 32.

Turning now to FIG. 4, it will be seen that the flat push bar 23 has a thickness which is substantially less than the diameter of the detent 17 and that the detent 17 is seated on the two surfaces 37 within the sloped portion 32 of the notch. This view depicts the position of the detent 17 relative to the push bar 23 when the detent is being urged by the push bar to protrude out of the bore 33.

The operation of the device will be apparent to those skilled in the art. When it is desired to mount a socket on the driving stud 16 of the wrench, the aperture formed in the socket is aligned with the driving stud and the socket may then be pressed onto the driving stud. The walls of the aperture 19 will force the detent 17 into the bore 33 and the sloping portion 32 of the notch 29 will cause a displacement of the push bar 23 allowing the detent to be received by the constant depth portion 31 of the notch. The V-shaped trough provides a positive seating surface for the detent 17 and prevents the push bar from becoming askewed with respect to the bore 33.

In the alternative, the button 14 may be depressed against the force of the coil spring. The depression of the button causes the push bar 23 to shift toward the end of the driving stud 16. This shifting of the push bar allows the detent 17 to seat on the surfaces 36 of the notch 29. In this position, the outer surface of the driving stud 16 is not interrupted by the protrusion of the detent 17. Again, the V-shaped trough provides a positive seating surface for the detent 17 and prevents the push bar 23 from becoming askewed with respect to the bore 33.

When the socket is in place on the stud, and the button is released, the force of the spring 24 causes the push bar to shift so that the detent 17 is once again urged from the bore 33 by the sloping portion 32 of the notch 29. The V-shaped trough formed by the sloping surfaces 37 continues to provide a positive seating surface for the detent 17. Without this V-shaped trough, the push bar 23 in its shifting operation may begin to turn or skew relative to the detent 17 and the bore 33. Such skewing may cause the push bar 23 to turn such that the notch 29 is completely out of alignment with the bore 33 rendering the detent mechanism inoperative. Further, the detent 17 may become jammed between the sides of the bore 33 and edge of the notch 29. The provision of the V-shaped trough within the notch precludes these undesirable results.

Having thus described the invention, various modifications and alterations will occur to those skilled in the art, which modifications and alterations are intended to be within the scope of the present invention as defined in the appended claims.

I claim:

1. In a socket wrench having an elongated handle, a head on one end of the handle, a driving stud protruding from the head for driving by engaging a socket thereon, and an axial passage in the driving stud, a mechanism comprising:

an aperture in a side wall of said driving stud communicating with the axial passage, a spherical detent positioned within the aperture, an elongated flat push bar means in the axial passage for urging the detent to protrude from the side wall through the aperture, the flat push bar means having a thickness which is substantially less than the diameter of the spherical detent, a notch in one end of the flat push bar means, the notch comprising a constant depth portion and a sloped portion wherein the sloped portion is effective at one end thereof to urge the detent to protrude from the aperture and at the other end to allow the detent to retract into the aperture, resilient means for biasing said push bar means, and two surface means in the sloped portion of the notch, the two surface means contacting the spherical detent at spaced points to provide a positive seating surface for the detent, to urge the detent to protrude from the aperture, and to prevent the push bar means from rotating within the driving stud.

2. The mechanism of claim 1 further comprising:

a V-shaped trough comprising said two surface means, the axis of said V-shaped trough and of the axial passage lying in a common plane which bisects the trough along the longitudinal axis of the V.

3. The mechanism of claim 1 further comprising:

button means for actuating the push bar means against the biasing force of the resilient means, whereby the detent may retract into the aperture, and a convex surface formed on the abutting surface of the button means and said first means, whereby clutching between the button and the push bar means is prevented.

* * * * *